United States Patent [19]

Torgerson et al.

[11] Patent Number: 4,691,409

[45] Date of Patent: Sep. 8, 1987

[54] HINGE MASK

[75] Inventors: Gary D. Torgerson; Joyce E. Ferm, both of Seattle, Wash.

[73] Assignee: Ferm & Torgerson Partnership, Seattle, Wash.

[21] Appl. No.: 941,790

[22] Filed: Dec. 15, 1986

Related U.S. Application Data

[63] Continuation-in-part of Ser. No. 859,409, May 5, 1986, abandoned.

[51] Int. Cl.[4] ..... E05D 11/00

[52] U.S. Cl. ..... 16/250; 118/505

[58] Field of Search ..... 16/250; 427/272, 282; 118/301, 505

[56] References Cited

U.S. PATENT DOCUMENTS

| | | | |
|---|---|---|---|
| 2,047,909 | 7/1936 | North | 16/250 |
| 2,342,453 | 2/1944 | Colucci | 16/250 |
| 2,586,757 | 2/1952 | Wummel et al. | 16/250 |
| 4,195,590 | 4/1980 | Herrington | 427/282 |
| 4,570,291 | 2/1986 | Smith et al. | 16/250 |

*Primary Examiner*—M. Jordan

*Attorney, Agent, or Firm*—Christensen, O'Connor, Johnson & Kindness

[57] ABSTRACT

A hinge mask primarily for spray painting, comprising a body of elastic sheet material and fastening means that may include a pair of hooks (40, 42) or a loop (80) fastened to the body. The body includes a first body portion (12) and a second body portion (14). The first body portion includes first (30) and second (32) concave sections and an intermediate section (34) extending between the concave sections. The concave sections face one another, and the intermediate section has a longitudinal opening (36) extending between the concave sections. The second body portion comprises an elongated member having first and second ends, the first end of the second body portion being secured to the second concave section. The two hooks are fastened to the second body portion near the second end thereof, and are oriented projecting towards the first end. The third body portion (16) may be provided secured to the first concave section.

15 Claims, 10 Drawing Figures

HINGE MASK

RELATED APPLICATIONS

This application is a continuation-in-part of application Ser. No. 859,409, filed May 5, 1986, now abandoned, for a Hinge Mask.

FIELD OF THE INVENTION

The present invention relates to masking devices for use during spray painting or similar operations.

BACKGROUND OF THE INVENTION

Masking is a step commonly performed prior to spray painting in order to cover surfaces or objects that are not to be painted. One of the most troublesome objects to mask properly is a door hinge. Although the flat plates of the hinge can be masked without difficult, the hinge barrel is a cumbersome shape to which to apply masking tape. Furthermore, a hinge barrel masked with conventional masking tape will frequently become partially unmasked as a door is of necessity moved or articulated to allow spray painting of all of its surfaces. For this reason, hinges are often removed entirely prior to painting, a time-consuming step. In addition, when hinges are removed, it is important to keep track of the location from which each hinge on each door came, in order to ensure that all doors will operate properly once their hinges are replaced.

SUMMARY OF THE INVENTION

The present invention provides an inexpensive and easy to use hinge mask that will reliably mask hinges of various sizes, and that permits articulation of the door with the hinge mask in place.

In a preferred embodiment, the hinge mask of the present invention comprises a body composed of an elastic sheet material, such as latex rubber, and fastening means. The body has first and second body portions, the first body portion having first and second concabe sections and a center section. The concave sections are adapted to overlap the ends of a hinge barrel. The center section extends between the concave sections, and the concabe sections open toward the center section has a longitudinal opening extending between the concave sections. The second body portion comprises an elongated member having first and second ends. The first end of the second body portion is secured to the second concave section. The fastening means is connected to (i.e., affixed to or integrally formed with) the second body portion near the second end thereof, and includes means for securing the second end to one end of the hinge. A third body portion may also be provided secured to the first concave section. The fastening means may comprise a pair of hooks adapted to engage the hinge plates, or a loop adapted to engage the hinge barrel.

In another preferred embodiment, the hinge mask comprises a body having an elongated shape and first and second body ends. The first body end comprises first fastening means for both covering a first hinge barrel end and for securing the first body end to a corresponding first hinge end. Second body end comprises second fastening means for securing the second body end to the first hinge barrel end after the first body end has been secured to and is covering the first hinge barrel end. The length of the body between the first and second body end is selected such that the first body end can be secured to the first hinge barrel end, and the hinge mask then stretched such that it extends along one side of the hinge barrel, over the second hinge barrel end, and along the opposite side of the hinge barrel to the first hinge barrel end, whereupon the second body end is secured to the first hinge barrel end to mask the hinge. The first fastening means may include a concave section of the body or a looped shape element in combination with a flap.

DETAILED DESCRIPTION OF THE DRAWINGS

Figure 1:
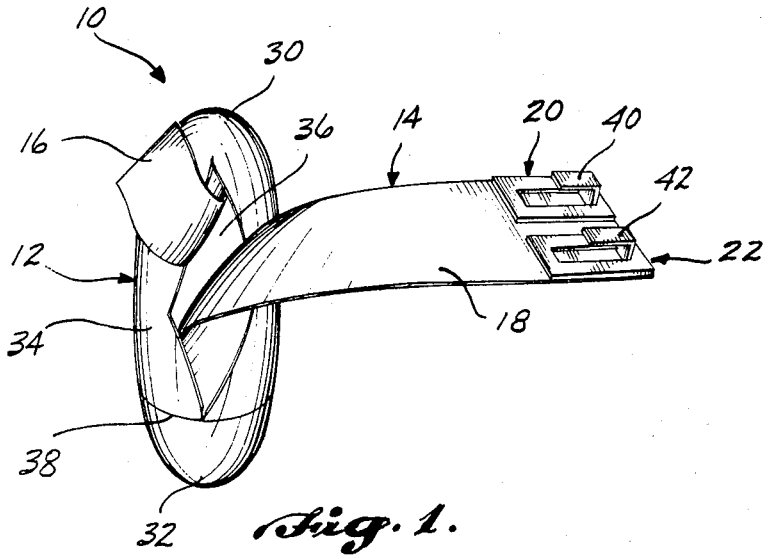
FIG. 1 is a perspective view of a preferred embodiment of the hinge mask of the present invention.

FIG. 1 provides a perspective view of one preferred embodiment of the hinge mask of the present invention. The hinge mask 10 comprises body 12, flaps 14 and 16, and fasteners 20 and 22. Body 12 and flaps 14 and 16 are composed of an elastic sheet material, such as latex rubber, and fasteners 20 and 22 are composed of metal, plastic, or any other suitable material. Body 12 has a somewhat elongated shape, and includes ends 30 and 32 and intermediate section 34. Ends 30 and 32 both have concave shapes facing towards one another and toward center portion 34. Intermediate section 34 includes longitudinal opening 36 that extends essentially the full length of the center portion from end 30 to end 32.

Flaps 14 and 16 are secured to the inner surfaces of end 32 and end 30, respectively, and extend out of body 12 via opening 36. Flap 14 preferably has an overall length greater than the length of body 12, and has fasteners 20 and 22 fastened to its outer end. Fasteners 20 and 22 include hooks 40 and 42, respectively, the hooks extending toward body 12. Flap 16 is shorter than flap 14, having a total length that preferably is about one-third the length of body 12.

Figure 2:
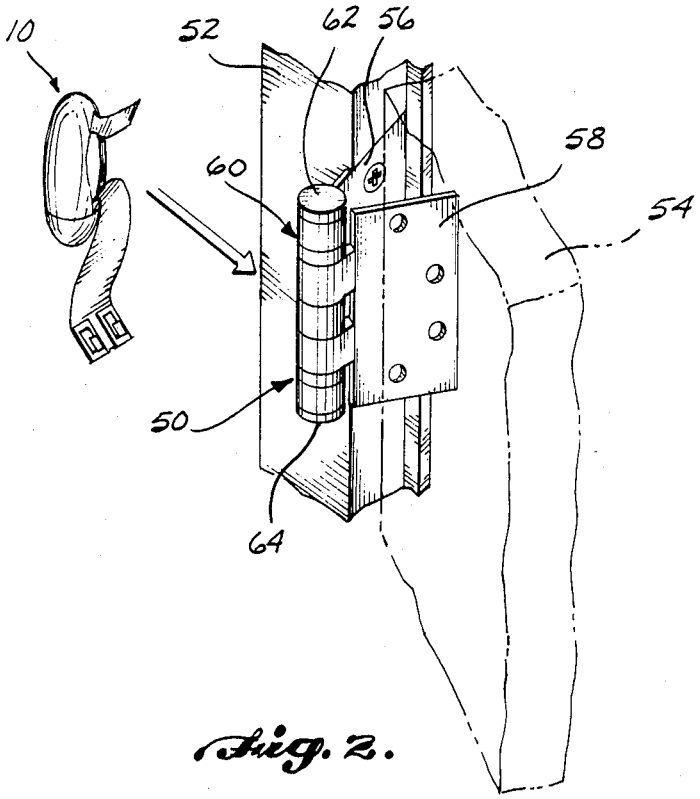
FIGS. 2–5 are a series of sequential perspective views showing the application of the hinge mask of FIG. 1 to a door hinge.

The use of hinge mask 10 is illustrated in FIGS. 2–5. FIG. 2 shows hinge mask 10 positioned adjacent hinge 50 that connects door frame 52 and door 54. Hinge 50 comprises hinge plates 56 and 58 and hinge barrel 60, the hinge barrel having upper end 62 and lower end 64. It is contemplated that during use of the present invention, plates 56 and 58 will be masked in place in a conventional manner using masking tape, and that hinge mask 10 will be used to mask hinge barrel 60.

Figure 3:
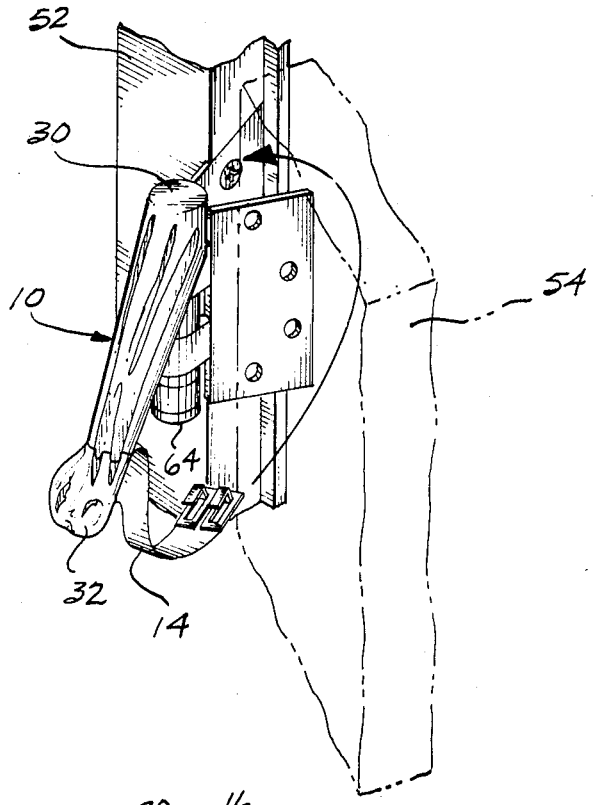
Figure 4:
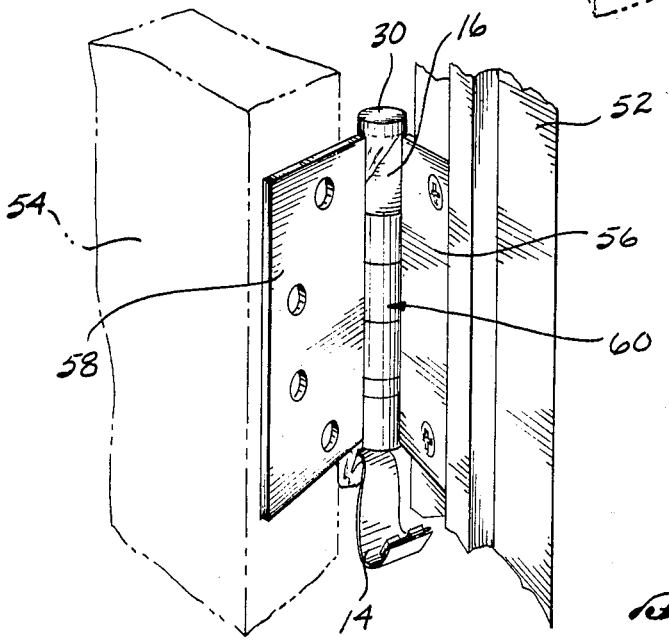
Figure 5:
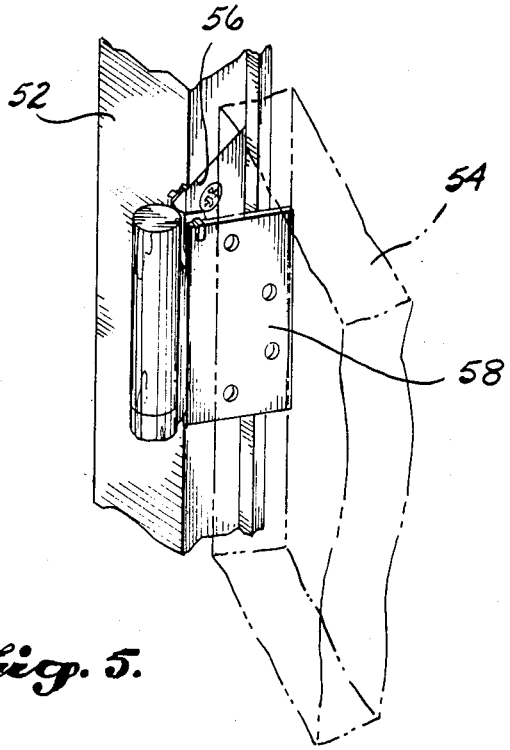

Referring now to FIGS. 3 and 4, the first step in applying hinge mask 10 to hinge barrel 60 is to place concave end 30 over upper end 62 of the hinge barrel, such that flap 16 extends downward along the backside of hinge barrel 60, as shown in FIG. 4. Concave end 32 of the hinge mask 10 is then pulled downward until it is adjacent lower end 64 of hinge barrel 60. Flap 14 is then inserted between frame 52 and door 54 beneath hinge 50, and concave end 32 is placed over lower end 64. Flap 14 is then pulled upward along the backside of the hinge barrel, and hooks 40 and 42 are placed over the upper edges of hinge plates 56 and 58, respectively, as shown in FIG. 5. The hinge mask is dimensioned such that when the hinge mask is positioned as shown in FIG. 5, there is elastic tension in body 12 and flap 14, such that the hinge mask is securely held on the hinge.

The hinge mask 10 may be fabricated by any one of a number of different hand or automated processes. For producing a small number of hinge masks, a particularly simple fabrication method is to start with two elongated balloons having ends corresponding to the desired shapes and sizes of concave ends 30 and 32. In this arrangement, concave end 30 and center section 34 are fabricated from one of the balloons, and concave end 32 and flap 14 are fabricated from the second balloon. Line 38 then represents the seam between the two balloons, which are sealed to one another by any suitable adhesive. Alternate fabrication techniques are described below in connection with further embodiments of the invention.

Fasteners 20 and 22 may be adhesively secured directly to upper side 18 at the outer end of flap 14, as shown in FIG. 1. Alternatively, fasteners 20 and 22 could be secured to the underside of flap 14, as viewed in FIG. 1, such that only hooks 40 and 42 extend through the flap to upper side 18. Other conventional fastening techniques could be used. The sizes and shapes of hooks 40 and 42 are not critical, so long as the hooks are capable of being secured to the free portion of hinge plates, as shown in FIG. 5. However the fasteners should be able to rotate with respect to one another, such that door 54 can be articulated with the hinge mask in place.

Figure 6:
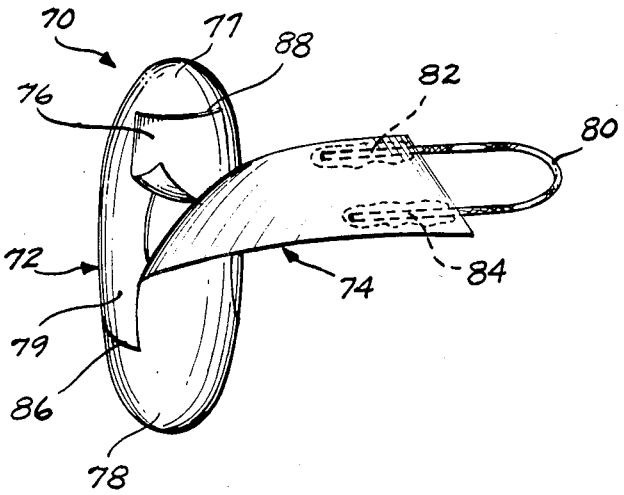
FIG. 6 is a perspective view of a second preferred embodiment of the hinge mask.

A second preferred embodiment of the hinge mask of the present invention is shown in FIG. 6. The hinge mask 70 of FIG. 6 comprises body 72 and flaps 74 and 76 that are essentially identical to the corresponding elements of the hinge mask of FIG. 1. Body 72 includes concave ends 77 and 78 and intermediate section 79. However, in the embodiment of FIG. 6, the fastener secured to the end of flap 74 comprises loop 80 that is secured to flap 74 at fastening points 82 and 84. Loop 80 may comprise a length of string having its ends secured to flap 74 by a suitable adhesive. Alternatively, loop 80 may be formed by cutting an opening in the end of flap 74. The body of the hinge mask of FIG. 6 may be fabricated from a first part comprising concave end 77 and intermediate section 79, a second part comprising concave end 78 and flap 74, and a third part comprising flap 76, all secured together by a suitable adhesive at seams 86 and 88 respectively.

Figure 7:
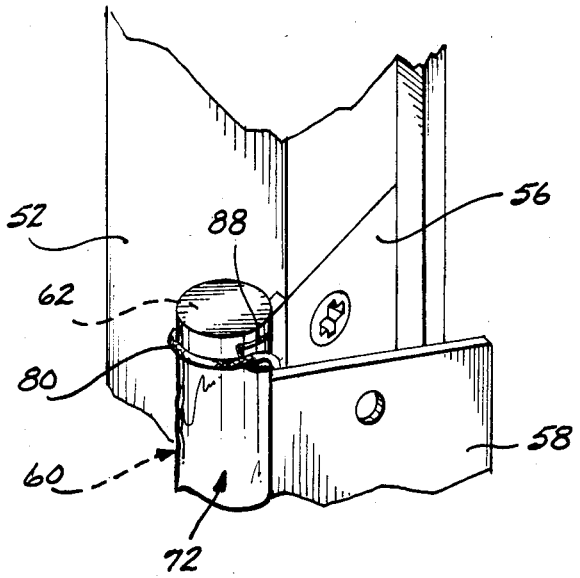
FIG. 7 is a partial perspective view showing the application of the hinge mask of FIG. 6 to a door hinge.

The application of hinge mask 70 to a hinge is illustrated in FIG. 7. The hinge mask is used in an identical manner to that shown in FIG. 5, except that flap 74 is fastened to the upper end 62 of hinge barrel 60 by passing loop 80 over the hinge barrel end and the upper end of body 72. Preferably, the thickness of the material used to form loop 80 is sufficiently large so that the loop does not pass downward between hinge barrel 60 and hinge plate 56 and 58, but rather passes over the upper ends of the hinge plate.

Figure 8:
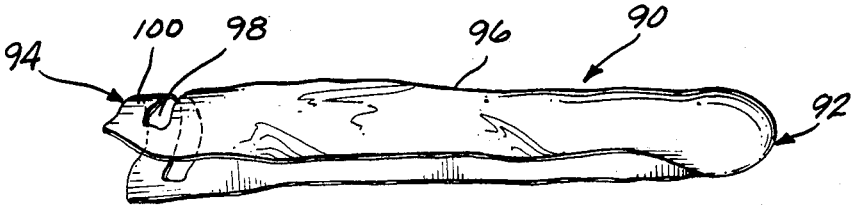
FIG. 8 is a perspective view of a third preferred embodiment of the hinge mask.

A third preferred embodiment of the present invention is illustrated by hinge mask 90 shown in FIG. 8. Hinge mask 90 comprises an elongated body having first end 92 and second end 94 connected by an elongated intermediate section 96. First end 92 has a concave shape, similar to end 30 of the hinge mask of FIG. 1. Second end 94 includes opening 98 that effectively forms an elastic loop 100 at the second end. Intermediate section 96 has a partial cylindrical shape. Hinge mask 90 is used to mask a hinge by placing first end 92 over one end of the hinge barrel, and then stretching the hinge mask such that it extends down along one side of the hinge barrel, around the second end of the hinge barrel, and then along the opposite side of the hinge barrel back to the first hinge barrel end. Loop 100 is then passed over the first end of the hinge barrel, in a manner generally similar to loop 80 shown in FIG. 7. Second end 94 may include reinforcing material along slit 98 to provide additional strength.

Figure 9:
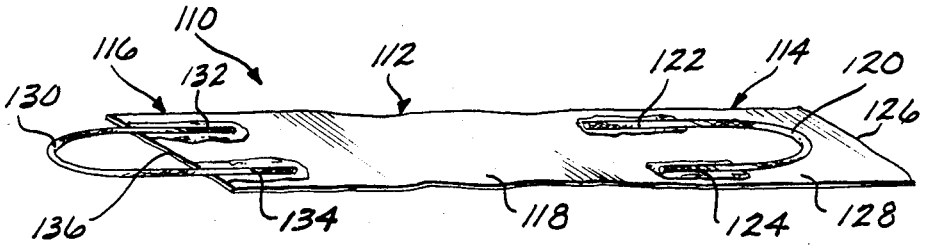
FIG. 9 is a perspective view of a fourth preferred embodiment of the hinge mask.

A fourth embodiment of the present invention is illustrated by hinge mask 110 shown in FIG. 9. Hinge mask 110 includes elongated body 112 having first end 114, second end 116 and elongated intermediate section 118. First end 114 includes loop 120 that is fastened to body 112 at fastening points 122 and 124. Fastening points 122 and 124 are spaced from edge 126 of body 112, to effectively form flap 128 at first end 114. Second end 116 includes loop 130 that is secured to body 112 at connection points 132 and 134. Connection points 132 and 134 are adjacent to edge 136 of body 112, in a manner generally similar to loop 80 shown in FIG. 6.

Figure 10:
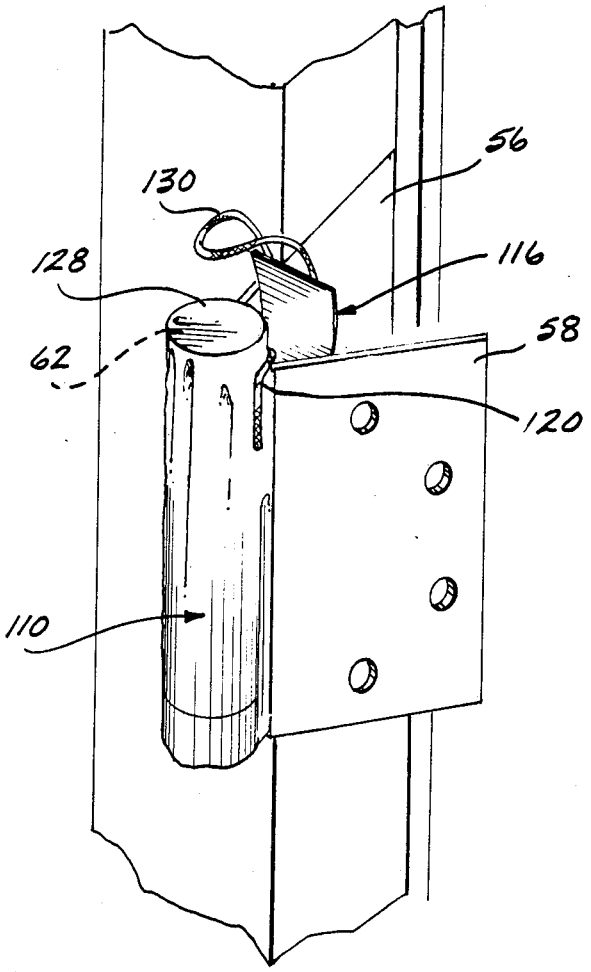
FIG. 10 is a perspective view showing the application of the hinge mask of FIG. 9 to a door hinge.

The application of hinge mask 110 to a hinge is illustrated in FIG. 10. First end 114 is first secured to one end 62 of hinge barrel 60 by covering end 62 with flap 128 and then passing loop 120 over the hinge barrel end and flap. The hinge mask is then pulled down one side of the hinge barrel, over the opposite hinge barrel end, and up the other side of the hinge barrel. Loop 130 is then passed over flap 128 and hinge barrel end 62, to secure end 116 to the hinge barrel.

While the preferred embodiments of the invention have been illustrated and described, it is to be understood that variations will be apparent to those skilled in the art. For example, flap 16 is not an essential element of the present invention, and may be omitted for certain applications, as illustrated by the embodiments of FIGS. 6–10. The function of flap 16 is to provide backup for flap 14 near the top of the hinge barrel, particularly as the door is articulated with the hinge mask in place. Accordingly, the invention is not limited to the specific embodiments described herein, and the true scope and spirit of the invention is to be determined by reference to the following claims.

The embodiments of the invention in which an exclusive property or privilege is claimed are defined as follows:

1. A hinge mask for masking a hinge that includes a hinge barrel and a pair of hinge plates, the hinge mask comprising a body composed of an elastic sheet material and fastening means, the body comprising first and second body portions, the first body portion having first and second concave sections and an intermediate section extending between the concave sections with the concave sections opening towards the intermediate section and the intermediate section having a longitudinal opening extending between the concave sections, the second body portion comprising an elongated member having first and second ends, the first end of the second body portion being secured to the second concave section, the fastening means being connected to the second body portion near the second end thereof and including means for securing the second end to one end of the hinge.

2. The hinge mask of claim 1, wherein the body further comprises a third body portion, the third body portion comprising an elongated member having first and second ends, the first end of the third body portion being secured to the first concave section.

3. The hinge mask of claim 2, wherein the second body portion has a length greater than the length of the first body portion, and wherein the third body portion has a length less than the length of the first body portion.

4. The hinge mask of claim 1, wherein the fastening means comprises two hooks fastened to the second body portion near the second end thereof, the hooks being oriented such that they project towards the first end, each hook being dimensioned such that it can engage one end of a hinge plate.

5. The hinge mask of claim 4, wherein the hooks are fastened to the second body portion such that the hooks can rotate with respect to one another.

6. The hinge mask of claim 1, wherein the fastening means comprises a loop shaped fastening element connected to the second body portion near the second end thereof, the loop shaped element being dimensioned such that it can engage one end of the hinge barrel.

7. The hinge mask, comprising a body composed of an elastic sheet material and two hooks fastened to the body, the body comprising first and second body portions, the first body portion being capable of assuming the general shape of a hollow cylinder having first and second concave sections and an intermediate section extending between the concave sections, the concave sections opening towards the intermediate section, the intermediate section having a longitudinal opening extending between the concave sections, the second body portion comprising an elongated member having first and second ends, the first end of the second body portion being secured to the second concave section, the two hooks being fastened to the second body portion near the second end thereof, the hooks being oriented such that they project towards the first end.

8. The hinge mask of claim 7, wherein the body further comprises a third body portion, the third body portion comprising an elongated member having first and second ends, the first end of the third body portion being secured to the first concave section.

9. The hinge mask of claim 8, wherein the second body portion has a length greater than the length of the first body portion, and wherein the third body portion has a length less than the length of the first body portion.

10. The hinge mask of claim 7, where the hooks are fastened to the second body portion such that the hooks can rotate with respect to one another.

11. A hinge mask for masking a hinge having first and second hinge ends that includes a hinge barrel having corresponding first and second hinge barrel ends, the hinge mask comprising:

a body composed of an elastic sheet material, the body having an elongated shape and first and second body ends, the first body end comprising first fastening means for both covering the first hinge barrel end and for securing the first body end to the first hinge end, the second body end comprising second fastening means for securing the second body end to the first hinge barrel end after the first body end has been secured to and is covering the first hinge barrel end, the length of the body between the first and second body ends being selected such that the first body end can be secured to the first hinge barrel end, and the hinge mask can then be stretched such that it extends along one side of the hinge barrel, over the second hinge barrel end, and along the opposite side of the hinge barrel to the first hinge barrel end, whereupon the second body end can be secured to the first hinge barrel end to mask the hinge.

12. The hinge mask of claim 11, wherein the first fastening means includes a concave section of the body dimensioned to fit over the first hinge barrel end.

13. The hinge mask of claim 11, wherein the first fastening means comprises a loop shaped fastening element dimensioned such that it can engage the first hinge barrel end, the fastening element being connected to the body at one or more connection points spaced a predetermined distance from the first body end, said predetermined distance being selected such that the body between the connection points and the first body end forms a flap that is large enough to cover the first hinge barrel end when said fastening element engages the first hinge barrel end.

14. The hinge mask of claims 11, 12, or 13, wherein the second fastening means comprises an opening formed in the body adjacent to the second body end, the opening being dimensioned such that the first hinge barrel end can pass through it.

15. The hinge mask of claims 11, 12 or 13, wherein the second fastening means comprises a loop shaped fastening element connected to the body adjacent the second body end, the loop shaped fastening element being dimensioned such that it can engage the first hinge barrel end.

* * * * *